US009604246B2

(12) United States Patent
Miura et al.

(10) Patent No.: US 9,604,246 B2
(45) Date of Patent: Mar. 28, 2017

(54) DOUBLE-SIDED COATING DEVICE

(71) Applicants: FUJI KIKAI KOGYO CO., LTD., Hiroshima (JP); TOYOTA JIDOSHA KABUSHIKI KAISHA, Aichi (JP)

(72) Inventors: Hidenobu Miura, Hiroshima (JP); Masakazu Umehara, Aichi (JP)

(73) Assignees: FUJI KIKAI KOGYO CO., LTD., Hiroshima (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 0 days.

(21) Appl. No.: 14/892,786

(22) PCT Filed: May 7, 2014

(86) PCT No.: PCT/JP2014/002424

§ 371 (c)(1),
(2) Date: Nov. 20, 2015

(87) PCT Pub. No.: WO2014/188671

PCT Pub. Date: Nov. 27, 2014

(65) Prior Publication Data

US 2016/0129472 A1 May 12, 2016

(30) Foreign Application Priority Data

May 24, 2013 (JP) ..... 2013-109941

(51) Int. Cl.
*B05C 1/00* (2006.01)
*B05C 13/02* (2006.01)
(Continued)

(52) U.S. Cl.
CPC ..... *B05C 19/008* (2013.01); *B05C 1/0826* (2013.01); *B05C 9/04* (2013.01); *B05C 1/0839* (2013.01); *B05C 9/14* (2013.01)

(58) Field of Classification Search
USPC ..... 118/244, 212, 235, 221, 223, 252, 255, 118/58, 63, 66
See application file for complete search history.

(56) References Cited

U.S. PATENT DOCUMENTS 4,791,881 A * 12/1988 Iwasaki ..... B05C 1/08 118/212
5,281,472 A * 1/1994 Takahashi ..... C08J 7/047 428/336

(Continued)

FOREIGN PATENT DOCUMENTS

JP 2003-251241 A 9/2003
JP 2004-230248 A 8/2004

(Continued)

OTHER PUBLICATIONS

English Translation KR101199219B1, Nov. 2012.*
International Search Report for corresponding International Application No. PCT/JP2014/002424, dated Jun. 10, 2014.

*Primary Examiner* — Yewebdar Tadesse
(74) *Attorney, Agent, or Firm* — Renner, Otto, Boisselle & Sklar, LLP

(57) ABSTRACT

A double-sided coater 1 includes a first coater 5*a* coating a surface not contacting a guide roll 4*b*, and a second coater 5*b* coating another surface contacting the guide roll 4*b*. Each of the first and second coaters 5*a* and 5*b* includes a gravure kiss coater including a small-diameter gravure roll 10 and a coating liquid supplier 30. The guide roll 4*b* guides a substrate S from a vertical direction to a horizontal direction to allow the first coater 5*a* to coat the substrate S from a lateral point while the substrate S travels vertically, and to allow the second coater 5*b* to coat the substrate S from a lower point while the substrate S travels horizontally.

2 Claims, 8 Drawing Sheets

(51) Int. Cl.

| | |
|---|---|
| ***B05C 19/00*** | (2006.01) |
| ***B05C 9/04*** | (2006.01) |
| ***B05C 1/08*** | (2006.01) |
| *B05C 9/14* | (2006.01) |

(56) References Cited

U.S. PATENT DOCUMENTS

| | | | | |
|---|---|---|---|---|
| 2007/0253062 | A1* | 11/2007 | Shimoda | G02B 1/111 359/580 |
| 2010/0143699 | A1* | 6/2010 | Aoyama | B32B 27/36 428/319.7 |
| 2012/0103252 | A1 | 5/2012 | Watanabe | |

FOREIGN PATENT DOCUMENTS

| | | | |
|---|---|---|---|
| JP | 2004-291314 | A | 10/2004 |
| JP | 2007-029789 | A | 2/2007 |
| JP | 2010-221204 | A | 10/2010 |
| JP | 2011-092915 | A | 5/2011 |
| JP | 2012-130907 | A | 7/2012 |
| JP | 2012-170835 | A | 9/2012 |
| JP | 2012-239976 | A | 12/2012 |
| KR | 101199219 | B1 * | 11/2012 |
| WO | WO 2011/001648 | A1 | 1/2011 |

* cited by examiner

DOUBLE-SIDED COATING DEVICE

TECHNICAL FIELD

The present invention relates to double-sided coaters continuously coating both sides of a traveling sheet-like substrate, and more particularly to double-sided coaters, which are gravure kiss coaters including a gravure roll with a small outside diameter.

BACKGROUND ART

A gravure kiss coater is an apparatus configured to coat a sheet-like substrate that travels while being stretched and floating by rotating a gravure roll on which a coating liquid is deposited and simultaneously allowing the gravure roll to contact the substrate.

Patent Document 1 discloses a double-sided coater being a gravure kiss coater including a gravure roll with a small outside diameter.

According to the document, first and second coating rolls coating both sides of a substrate are disposed between upstream and downstream guide rolls supporting the substrate.

Patent Documents 2 and 3 disclose a double-sided coater, which is not a gravure kiss coater. Patent Document 3 teaches disposing, between a double-sided coating mechanism and a dryer, a clamp means nipping and clamping the ends of a substrate to prevent flapping of the substrate after double-sided printing.

CITATION LIST

Patent Document

[Patent Document 1] Japanese Unexamined Patent Publication No. 2010-221204

[Patent Document 2] Japanese Unexamined Patent Publication No. 2011-92915

[Patent Document 3] Japanese Unexamined Patent Publication No. 2007-29789

SUMMARY OF THE INVENTION

Technical Problem

Like the coater shown in Patent Document 1, a gravure kiss coater typically coats a substrate traveling between a pair of guide rolls. It is thus necessary in double-sided coating to dry the surface of the substrate contacting the guide rolls before reaching the downstream guide roll. Therefore, the coater of Patent Document 1 includes a dryer before the downstream guide roll.

Although drying requires a certain time, the substrate continuously travels and the traveling direction is unchangeable. It is thus inevitable that a distance between the pair of guide rolls increases. As a result, the contact between the substrate and the gravure roll becomes unstable, and in addition, the size of the coater as a whole increases one-dimensionally, which is a problem.

It is an object of the present invention to provide a downsized double-sided coater with excellent coating capabilities.

Solution to the Problem

Herein disclosed is a double-sided coater continuously coating two surfaces of a traveling sheet-like substrate. This double-sided coater includes a guide roll wound with the substrate and guiding a traveling direction of the substrate; a first coater located next to and upstream of the guide roll, and coating one of the surfaces not contacting the guide roll; a second coater located next to and downstream of the guide roll, and coating the other one of the surfaces contacting the guide roll; and a floating drier drying the substrate with the coated surfaces.

Each of the first and second coaters is a gravure kiss coater including a cylindrical small-diameter gravure roll having an outside diameter within a range from 45 mm to 150 mm, and including, on an outer peripheral surface, a coating section contacting the traveling substrate while floating, and an enclosed coating liquid supplier capable of being placed transversely, the coating liquid supplier extending along the small-diameter gravure roll, and supplying coating liquid to the coating section. The guide roll guides the substrate from a vertical direction to a horizontal direction to allow the first coater to coat the substrate from a lateral point while the substrates travels vertically, and to allow the second coater to coat the substrate from a lower point while the substrate travels horizontally.

The double-sided coater includes two gravure kiss coaters, the first and second coaters capable of being placed transversely, each of which includes the gravure roll with the small outside diameter. The substrate guided by the guide roll from the vertical direction to the horizontal direction is coated by the first coater from the lateral point while travelling vertically, and coated by the second coater from the lower point while travelling horizontally. Thus, both the two coaters are arranged two-dimensionally collectively. This simple configuration enables highly accurate double-sided coating, and downsizing of the whole double-sided coater.

Specifically, in a transverse position, an uppermost end of the coating liquid supplier of the second coater may be located under a tangent line tangent to an upper end of the small-diameter gravure roll as seen along a rotational axis of the small-diameter gravure roll. Both the first and second coaters may be placed transversely.

This configuration allows both the first and second coaters to similarly supply the coating liquid to the small-diameter gravure roll. This leads to uniform coating conditions between both the surfaces of the substrate and highly accurate coating.

In particular, the substrate may include a non-coated region at its ends in a width direction. The double-sided coater further includes, between the second coater and the floating drier, an end supporter clamping the non-coated region of the traveling substrate.

This configuration enables stable feeding of the substrate to the floating drier and stable coating of the second coater at the same time, and further downsizing of the whole double-sided coater.

Advantages of the Invention

A double-sided coater according to the present invention enables downsizing of the whole coater and improvement in coating capabilities.

DESCRIPTION OF EMBODIMENTS

Embodiments of the present invention will now be described with reference to the drawings. Note that the following description is a mere example in nature and is not intended to limit the scope of the present invention, equivalents, and applications.

Figure 1:
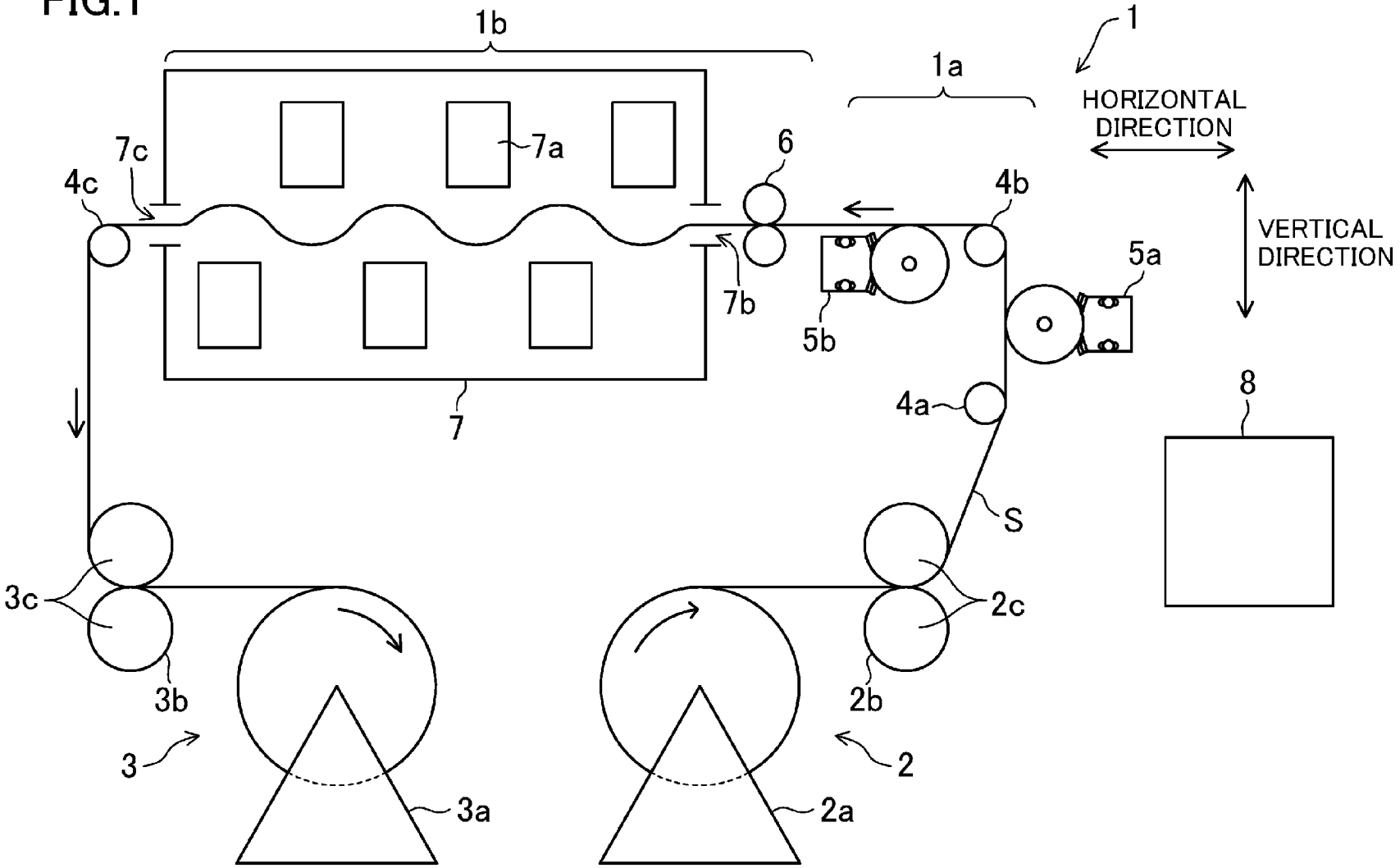
FIG. 1 is a general view of a double-sided coater disclosed herein.

FIG. 1 illustrates a double-sided coater 1 according to an embodiment. The double-sided coater 1 includes an unwinder 2, a winder 3, a plurality of guide rolls 4*a*-4*c*, a first coater 5*a*, a second coater 5*b*, an end supporter 6, a floating drier 7, and a controller 8, for example.

The controller 8 includes various types of software such as a control program, and hardware such as a computer loaded with such software, and comprehensively controls the double-sided coater 1 as a whole. The controller 8 controls operations of the unwinder 2, the winder 3, the first coater 5*a*, the second coater 5*b*, the end supporter 6, the floating drier 7, etc.

The controller 8 controls the double-sided coater 1 to continuously perform a series of processing of double-sided coating and drying of a substrate S which travels while being wound and fed.

The substrate S is a flexible sheet-like member made of plastic, metal, etc. The substrate S has a long band-like shape, and is fed to the double-sided coater 1 while being wound in a roll around a core.

Figure 3:
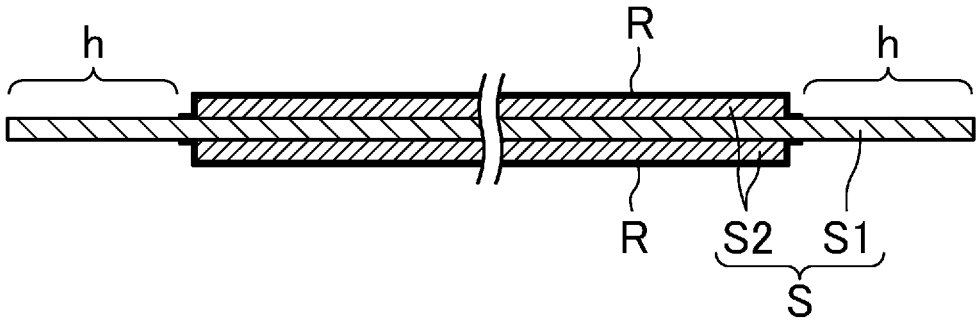
FIG. 3 is a general cross-sectional view of a substrate with the surfaces coated.

In this embodiment, the substrate S is made of a negative electrode material of a lithium ion secondary battery (see FIG. 3). The substrate S includes copper foil S1 as a base, and graphite layers S2. The copper foil S1 has a thickness of 10-20 μm. The graphite layers S2 have a thickness of 100 μm or smaller, and are formed on both sides of the copper foil S1 except the edges of the foil.

The graphite layers S2 are covered by heat-resistant protective layers R with a thickness of 2-5 μm. This double-sided coater 1 is used to form these ultrathin heat-resistant protective layers R.

The unwinder 2 includes a supporter 2*a* and an upstream feeder 2*b*. The supporter 2*a* unwinds the roll-like substrate S. The upstream feeder 2*b* feeds the substrate S at a predetermined speed in synchronization with the supporter 2*a*. The upstream feeder 2*b* includes a pair of pressure rolls 2*c* sandwiching the substrate S. These pressure rolls 2*c* rotate to feed the substrate S at a constant speed.

The substrate S fed by the unwinder 2 passes through a processing zone for coating and drying, while being supported and guided by the rotatable guide rolls 4*a*-4*c*, and is then wound by the winder 3. A coating zone 1*a* for coating is located at the earlier stage of the processing zone. A drying zone 1*b* for drying is located at the later stage of the processing zone.

The winder 3 includes a supporter 3*a* and a downstream feeder 3*b*. The supporter 3*a* winds up the substrate S. The downstream feeder 3*b* draws the substrate S from the processing zone in synchronization with the supporter 3*a*. The winder 3 operates in conjunction with the unwinder 2. The downstream feeder 3*b* also includes a pair of pressure rolls 3*c* sandwiching the substrate S. These pressure rolls 3*c* rotate so that the substrate S is drawn toward the supporter 3*a* at a constant speed, and is wound by a core in the supporter 3*a*.

Figure 2:
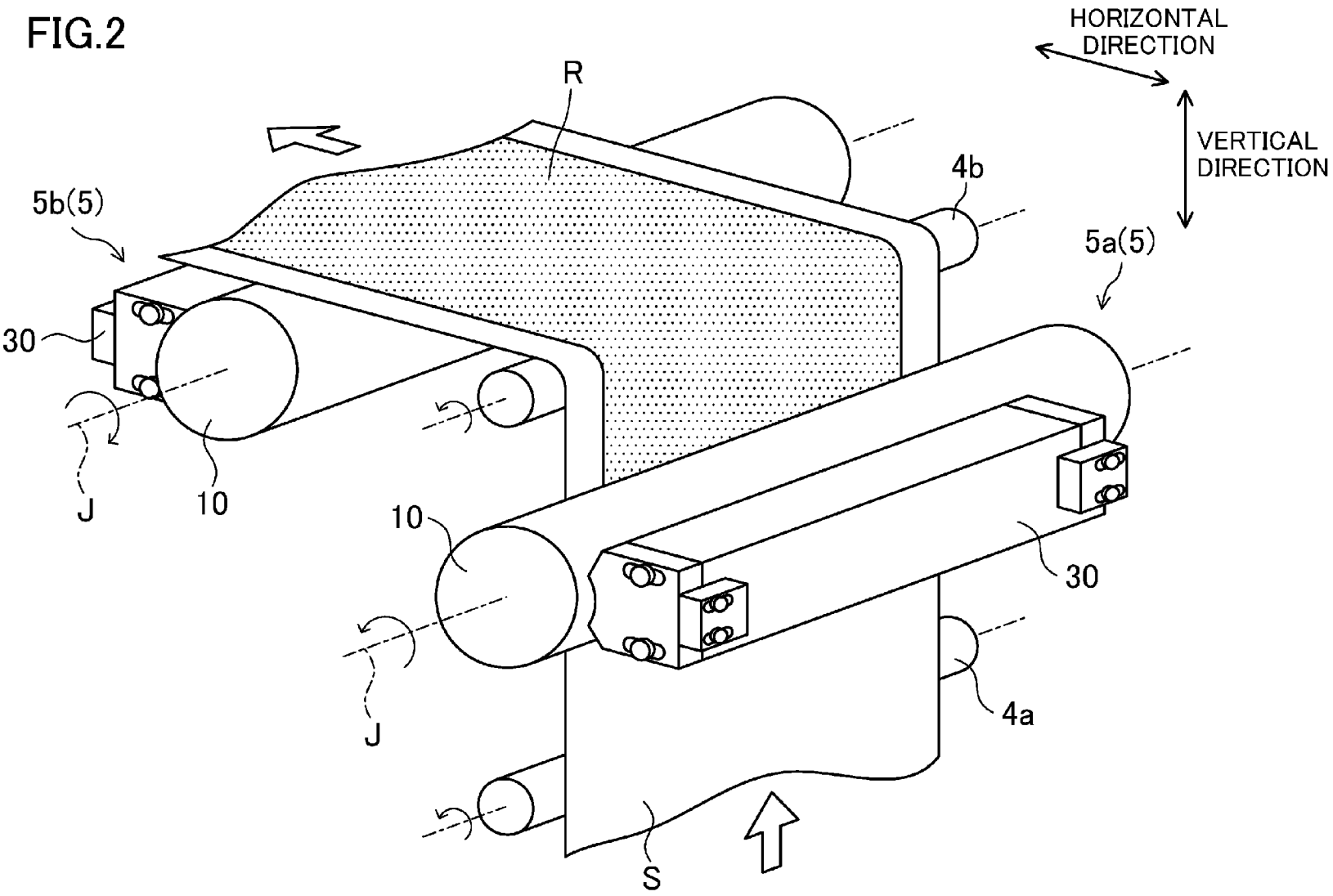
FIG. 2 is a general perspective view of a coating zone.

As specifically shown in FIG. 2, the first guide roll 4*a*, the second guide roll 4*b*, the first coater 5*a*, and the second coater 5*b* are located in the coating zone 1*a*. The double-sided coater 1 employs creative arrangement of these elements to downsize the whole coater.

Specifically, the first and second guide rolls 4*a* and 4*b* are located on the same surface (hereinafter referred to as "second coating surface") of the substrate S. The substrate S is supported and guided by these guide rolls 4*a* and 4*b* in contacting the second coating surface so as to travel substantially vertically upward between the first and second guide roll 4*a* and 4*b*.

The first coater 5*a* is next to and upstream of the second guide roll 4*b*, and opposite to the first and second guide rolls 4*a* and 4*b* with respect to the substrate S traveling between the first and second guide roll 4*a* and 4*b*. The first coater 5*a* contacts the substrate S, which travels while being stretched and floating between the guide rolls 4*a* and 4*b*, from a lateral point to coat the surface (hereinafter referred to as "first coating surface") which is on the back side of the second coating surface.

The substrate S is wound by the second guide roll 4*b* to be supported and guided from the substantially vertical direction to the substantially horizontal direction, while generating tension. Since the first coating surface does not contact the second guide roll 4*b*, the second guide roll 4*b* supports and guides the substrate S even if the coating liquid used in the first coater 5*a* is not dried.

The second coater 5*b* is next to and downstream of the second guide roll 4*b*. The second coater 5*b* is located under the substrate S, which is wound by the second guide roll 4*b* and extends substantially horizontally, that is, on the same side as the first and second guide rolls 4*a* and 4*b*.

The second coater 5*b* contacts the substrate S, which travels while being substantially horizontally stretched by the second guide roll 4*b* and floating, from a lower point to coat the second coating surface.

As shown in FIG. 3, the both surfaces of the substrate S, which has passed through the second coater 5*b*, are coated to form the heat-resistant protective layers R on the first and second coating surfaces. This double-sided coater 1 has a non-coated region h at each end of the substrate S in the width direction. A coated region to be provided with the heat-resistant protective layer R is located between the non-coated regions h and h.

First and Second Coaters

In this double-sided coater 1, the same coater are used as the first and second coaters 5*a* and 5*b* (comprehensively also referred to as "coater 5"). The coater 5 includes a small-diameter gravure roll 10 and a coating liquid supplier 30, for example. Details of the coater 1 will be shown in FIGS. 4-6 using the second coater 5*b* as an example.

Small-Diameter Gravure Roll

The small-diameter gravure roll 10 is a cylindrical member longer than the width of the substrate S, and rotatably supported by a support member (not shown). The small-diameter gravure roll 10 is controlled to rotate around a rotational axis J in a predetermined rotation direction at a rotational speed associated with the travel of the substrate S.

The rotational direction of the small-diameter gravure roll 10 may be forward and reverse, and may be set as appropriate in accordance with use conditions. In this coater, however, the small-diameter gravure roll 10 rotates in the direction opposite to the traveling direction of the substrate S at a contact position P between the substrate S and the small-diameter gravure roll 10 (i.e., a reverse type).

The outside diameter D of the small-diameter gravure roll 10 falls within a range from 45 mm to 150 mm. With reduction in the outside diameter D, the contact time or the contact area between the substrate S and the small-diameter gravure roll 10 decreases. This leads to thin coating at high accuracy using a small mounting space.

The small-diameter gravure roll 10 has, on its outer periphery, a coating section 12 provided with cells of a predetermined pattern such as a lattice or diagonal lines. The coating section 12 has a width associated with the coated region of the substrate S. The position of the coating section 12 is determined to associate with the coated region. The coating liquid supplier 30 supplies the coating liquid to the coating section 12.

Coating Liquid Supplier

The coating liquid supplier 30 includes a case 31, a doctor blade 32, and a seal blade 33, for example. The coating liquid supplier 30 has an elongated prism shaped appearance, and is adjacent to the small-diameter gravure roll 10 so as to extend along the small-diameter gravure roll 10.

The case 31 includes an elongated main case 36 with a U-shaped cross section, and side covers 37 attached to the ends of the main case 36, for example. A storage space 38 storing the coating liquid is formed inside the case 31.

Figure 6:
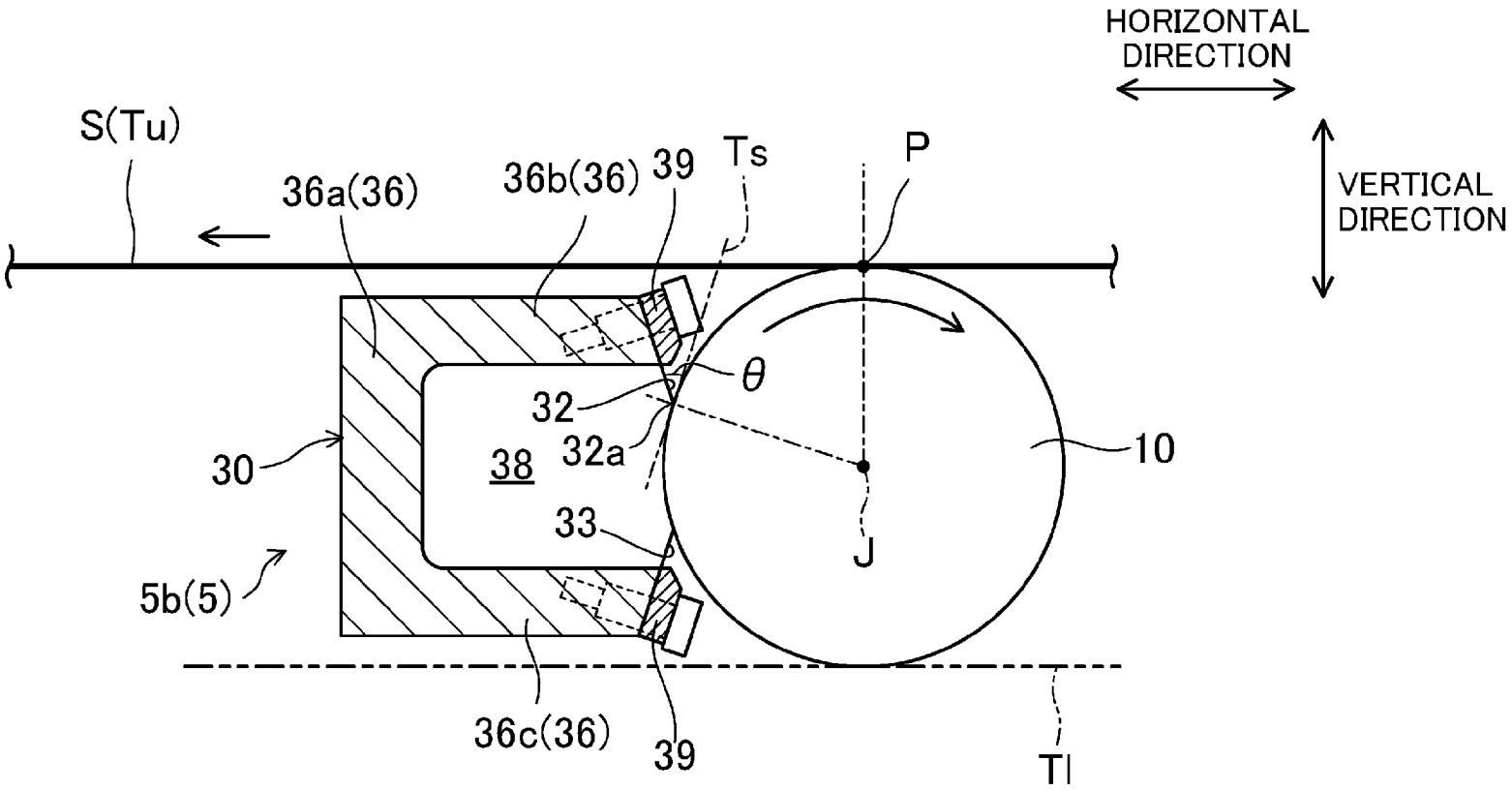
FIG. 6 is a general cross-sectional view taken along the line Y-Y'.

Specifically, as shown in FIG. 6, the main case 36 includes a base wall 36*a*, a downstream wall 36*b*, and an upstream wall 36*c*. The base wall 36*a* faces the small-diameter gravure roll 10, and has an elongated strip-like shape. The downstream and upstream walls 36*b* and 36*c* face each other and protrude from both longer edges of the base wall 36*a* toward the small-diameter gravure roll 10. The downstream and upstream walls 36*b* and 36*c* have the same elongated strip-like shape of the same size.

Figure 4:
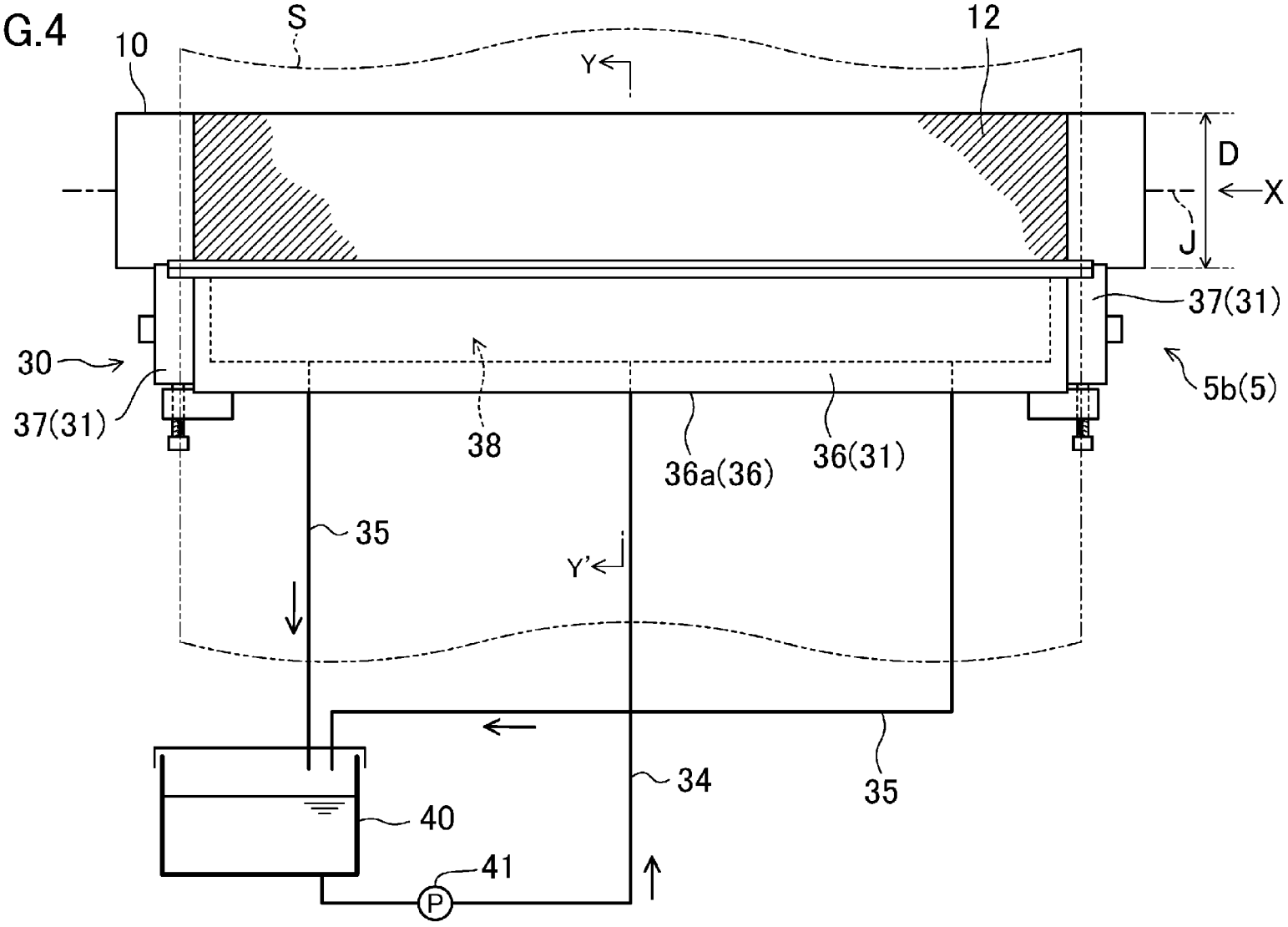
FIG. 4 is a general top view of a coater.

As shown in FIG. 4, the base wall 36*a* is connected to one ends of a liquid feed pipe 34 and a liquid return pipe 35. The storage space 38 communicates with these liquid feed and return pipes 34 and 35. The coater 5 is provided with a single liquid feed pipe 34 and two liquid return pipes 35. The liquid return pipes 35 are located at the respective ends of the storage space 38 to associate with the ends of the small-diameter gravure roll 10. The liquid feed pipe 34 is located at an intermediate portion between these liquid return pipes 35 and 35.

The other ends of the liquid feed and return pipes 34 and 35 are connected to a storage tank 40 storing the coating liquid. The coating liquid in the storage tank 40 is fed by a pump 41 through the liquid feed pipe 34 to the storage space 38. The coating liquid in the storage space 38 is returned through the liquid return pipes 35 to the storage tank 40. In operation of the coater, the coating liquid is supplied from the storage tank 40 to the storage space 38 through these liquid feed and return pipes 34 and 35 while circulating.

Figure 5:
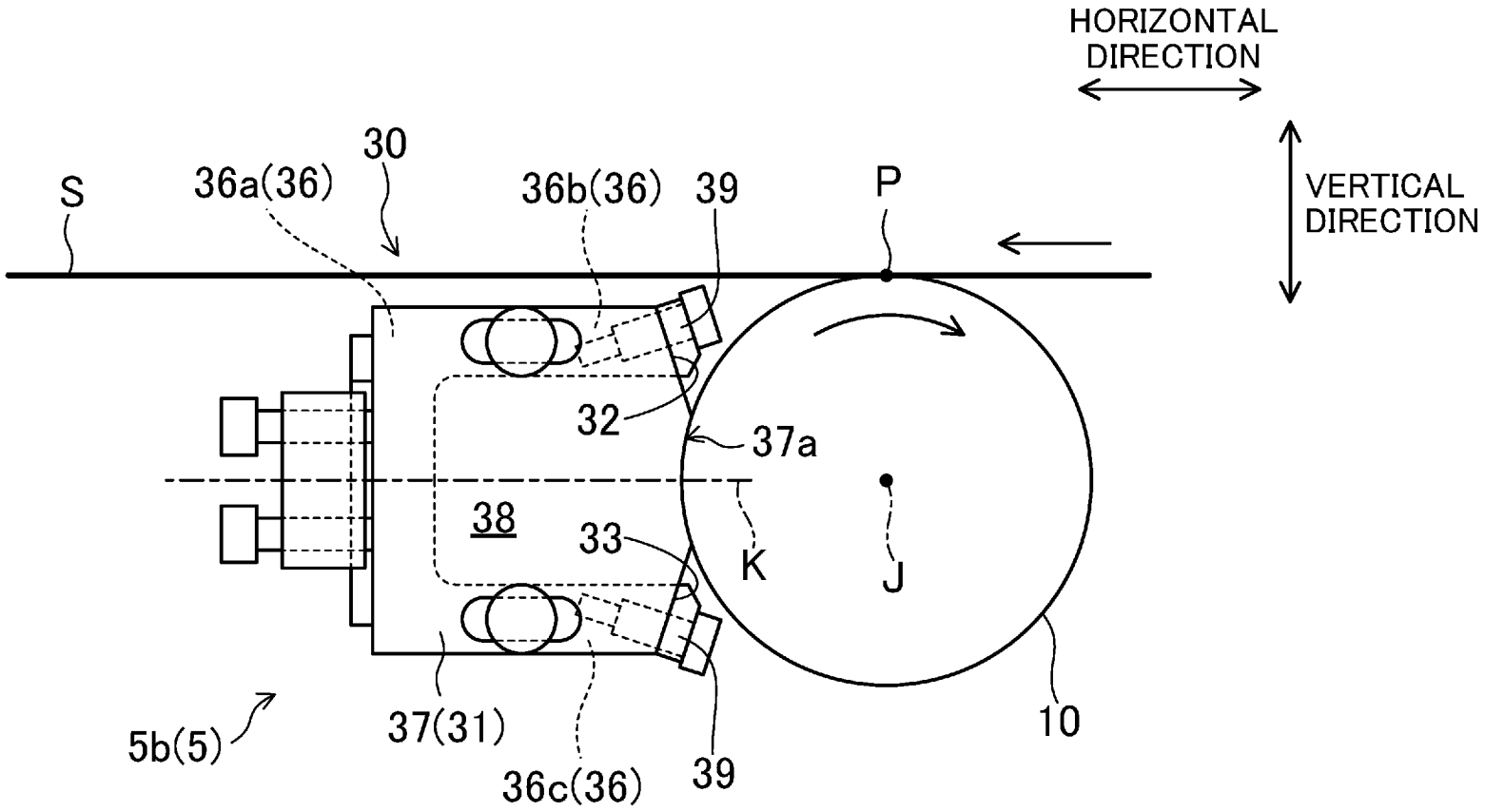
FIG. 5 is a general view taken along the arrow X of FIG. 4.

As shown in FIG. 5, the side covers 37 are engaged and fixed to the ends of the main case 36, and block the respective end surface of the main case 36. An arc-like seal portion 37*a*, which is in tight contact with the outer peripheral surface of the small-diameter gravure roll 10, is provided at the side edge of each side cover 37 at the small-diameter gravure roll 10. Each side cover 37 is slidable along the downstream and upstream walls 36*b* and 36*c*, and is fixed with a seal portion 37*a* contacting the outer peripheral surface of the small-diameter gravure roll 10.

The doctor blade 32 is attached to a protruding end of the downstream wall 36*b*. The surface of the protruding end of the downstream wall 36*b* is inclined such that the edge of the surface closer to the upstream wall 36*c* protrudes relatively largely. The doctor blade 32 is attached along the surface of the protruding end.

The doctor blade 32 is an elongated cutting member having an edge on one long side. The other long side of the doctor blade 32 is bolted to the surface of the protruding end of the downstream wall 36*b* while being pressed by a support bar 39.

A tip 32*a* of the doctor blade 32 with the edge obliquely protrudes toward the upstream wall 36*c* from the downstream wall 36*b*. The protruding tip 32*a* of the doctor blade 32 is in contact with the coating section 12 on the outer peripheral surface of the small-diameter gravure roll 10.

The tip 32*a* of the doctor blade 32 is in contact with the coating section 12 from a direction opposite to the rotational direction of the small-diameter gravure roll 10. Specifically, as shown in FIG. 6, the doctor blade 32 is placed so as to form an acute angle θ between the doctor blade 32 and a tangent line Ts, which is tangent to the contact point between the tip 32*a* and the coating section 12, on the forward side of the contact point in the rotational direction of the small-diameter gravure roll 10 as seen along the rotational axis J.

This placement of the doctor blade 32 allows accurate thin application of coating liquid to the small-diameter gravure roll 10. That is, the doctor blade 32 functions to smoothly scrape excessive coating liquid adhered to the coating section 12. Since the edge contacts the coating section 12 from the reverse direction, the excessive coating liquid is scraped wholly on the entire coating section 12 without pushing up the doctor blade 32 with the pressure of the liquid in a high speed operation.

This reduces variations in the amount of adhered coating liquid, and thus the coating liquid is stably applied onto the coating section 12 even in a high speed operation.

The seal blade 33 is a member similar to the doctor blade 32, and attached to a protruding end of the upstream wall 36*c*. In this coater 5, the seal blade 33 is made of plastic, and the doctor blade 32 is made of metal. As shown in FIG. 5, as seen along the rotational axis J, the doctor blade 32 and the seal blade 33 are symmetric, as well as the downstream and upstream walls 36*b* and 36*c*, about a reference line K passing the middle between the downstream and upstream walls 36*b* and 36*c*.

Therefore, the tip side of the seal blade 33 obliquely protrudes toward the downstream wall 36*b* from the upstream wall 36*c*. The protruding tip of the seal blade 33 is in contact with the coating section 12 on the outer peripheral surface of the small-diameter gravure roll 10.

As seen along the rotational axis J, the doctor blade 32 and the seal blade 33 form a V shape tapering toward the tips. The tip 32*a* of the doctor blade 32 contacts the coating section 12 before coating, which approaches a contact position P between the substrate S and the small-diameter gravure roll 10. The tip of the seal blade 33 contacts the coating section 12 after coating, which is away from the contact position P between the substrate S and the small-diameter gravure roll 10.

The ends of the main case 36 are blocked by the respective side covers 37, and the doctor blade 32, the seal blade 33, and both the side covers 37 are in contact with the small-diameter gravure roll 10. These enclose the storage space 38 storing the coating liquid inside the coating liquid supplier 30.

With this configuration, the coater 5 can be placed transversely such that the small-diameter gravure roll 10 and the coating liquid supplier 30 are aligned substantially horizontally. If the coater 5 is placed transversely, the inside of the storage space 38 is kept filled with coating liquid. Thus, the coating section 12 facing the inside of the storage space 38 is always in contact with the coating liquid. As a result, the coating liquid is stably supplied to the coating section 12 passing through the storage space 38 in accordance with the rotation of the small-diameter gravure roll 10.

In this coater 5, the creative configurations are used for the small-diameter gravure roll 10 and the coating liquid supplier 30, thereby placing the second coater 5*b* transversely under the substrate S traveling substantially horizontally.

Specifically, as shown in FIG. 6, when the transverse coater 5 is seen along the rotational axis J, the coating liquid supplier 30 is formed such that the uppermost end of the coating liquid supplier 30 including the downstream wall 36*b*, the support bar 39, and bolts, for example, is located under a tangent line Tu, which is in contact with the upper end of the small-diameter gravure roll 10 (which overlaps with the substrate S in FIG. 6).

In addition, in this coater 5, the coating liquid supplier 30 is formed such that the lowermost end of the coating liquid supplier 30 is located above a tangent line Tl tangent to the lower end of the small-diameter gravure roll 10. Specifically, both the uppermost and lowermost ends of the coating liquid supplier 30 are located between the pair of tangent lines Tu and Tl, which are in contact with the upper and lower ends of the small-diameter gravure roll 10.

Therefore, the coating liquid supplier 30 can be placed on each of right and left sides of the small-diameter gravure roll 10 without distinguishing the doctor blade 32 side from the seal blade 33 side, thereby increasing convenience in the placement. The transverse placement of the coater 5 ensures a sufficient space on the side of the small-diameter gravure roll 10 opposite to the coating liquid supplier 30. Thus, the second coater 5*b* can be located very close to the second guide roll 4*b*.

The second coater 5*b* is provided near the second guide roll 4*b* to allow the contact position P between the substrate S and the small-diameter gravure roll 10 to be closer to the second guide roll 4*b*. This reduces flapping of the substrate S at the contact position P, thereby enabling stable coating.

This results in compact arrangement and improvement in coating capabilities.

Since the first and second coaters 5*a* and 5*b* are next to and upstream and downstream of the second guide roll 4*b*, respectively, the contact positions P in both the coaters are close to each other, and the second guide roll 4*b* is located between the contact positions P. Thus, even if the substrate S is displaced in the width direction at the second guide roll 4*b*, the influence of the displacement may be efficiently reduced to improve coating capabilities.

Since both the first and second coaters 5*a* and 5*b* are placed transversely, the difference in coating conditions between the first and second coating surfaces are reduced.

Since typical coating liquid suppliers have been larger than small-diameter gravure rolls, coaters have been placed vertically to coat the substrate S traveling substantially horizontally. Specifically, a coater has been located under a substrate S with a coating liquid supplier positioned under a small-diameter gravure roll, or above the substrate S with the coating liquid supplier positioned above the small-diameter gravure roll.

In this case, however, since double-sided coating is performed by the coaters located longitudinally and transversely, the deposition conditions of the coating liquid to the respective small-diameter gravure rolls are different. This could cause a difference in the coating conditions between the surfaces. By contrast, since both the first and second coaters 5*a* and 5*b* are placed transversely, such a difference hardly occurs, thereby providing excellent coating capabilities.

End Supporter, Floating Drier

As shown in FIG. 1, in this double-sided coater 1, the substrate S with both the sides coated is immediately introduced into the floating drier 7 in the drying zone 1*b* and dried therein.

The floating drier 7 is a publicly known horizontally long device which dries a traveling substrate S while floating. A plurality of dryers 7*a* are placed vertically alternately inside the floating drier 7. The dryers 7*a* sprays dry air to the substrate S from respective vertical directions. The floating drier 7 has, at an upstream end, an inlet 7*b* from which the substrate S is fed in, and at a downstream end, an outlet 7*c* from which the substrate S is fed out.

The third guide roll 4*c* is provided near the outlet 7*c* between the floating drier 7 and the winder 3. The third guide roll 4*c* supports the substrate S fed out from the outlet 7*c* and guided to the winder 3.

Figure 7:
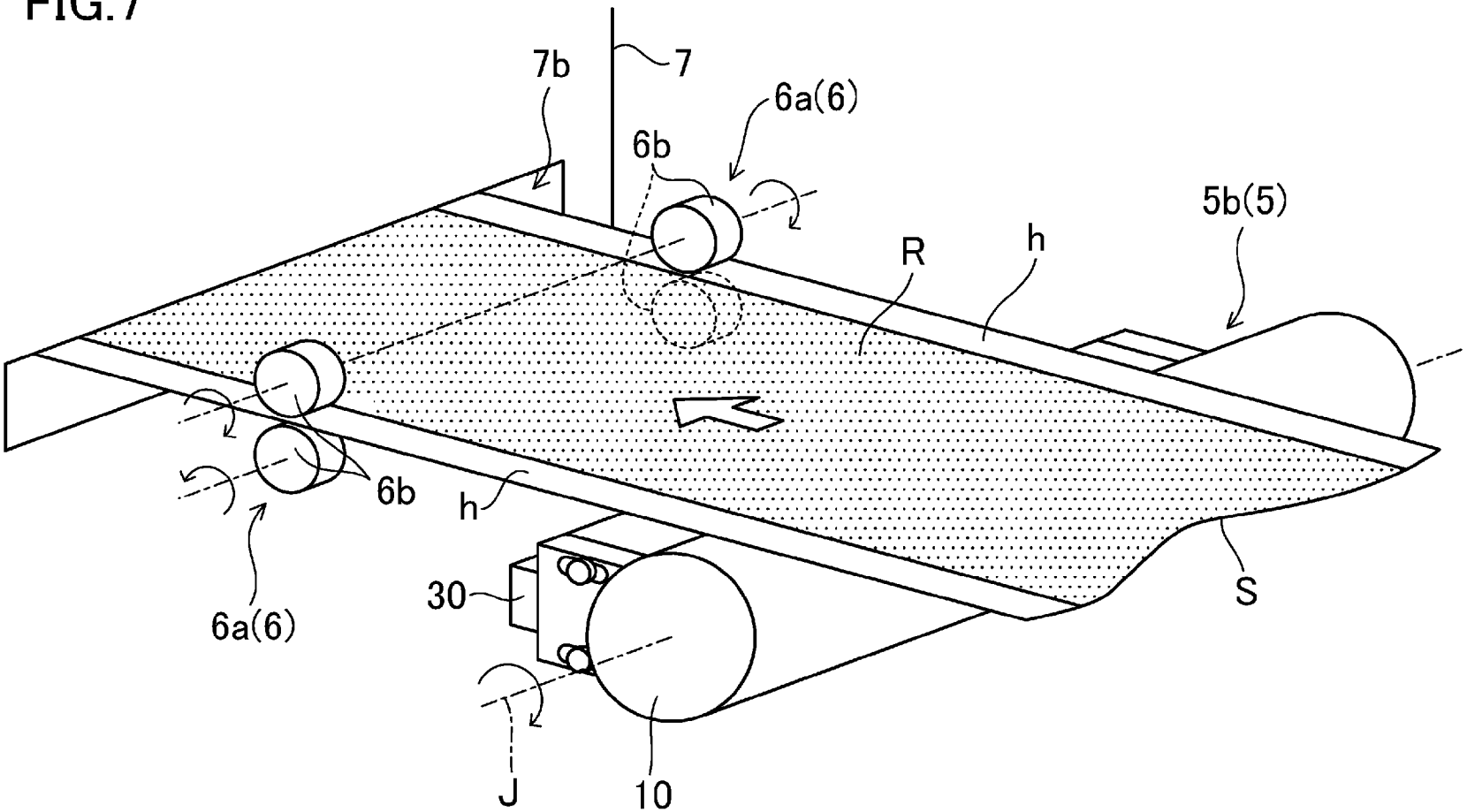
FIG. 7 is a general perspective view from a coating zone to a drying zone.

As specifically shown in FIG. 7, the end supporter 6 is provided near the inlet 7*b* between the second coater 5*b* and the floating drier 7.

The end supporter 6 includes a pair of clamps 6*a* and 6*a*, which clamp non-coated regions h at the ends of the substrate S. Each clamp 6*a* has a pair of upper and lower rotatable support rolls 6*b*. These support rolls 6*b* sandwich the non-coated regions h vertically.

The end supporter 6 clamps the ends of the substrate S, thereby reducing influence of the substrate S flapping inside the floating drier 7 on the second coater 5*b* while stably feeding the substrate S to the floating drier 7.

Furthermore, the floating drier 7 and the end supporter 6 can be adjacent to the second coater 5*b*. This stabilizes the contact between the substrate S and the second coater 5*b* in conjunction with the second guide roll 4*b*. This leads to stable coating of the second coater 5*b* and downsizing of the whole double-sided coater 1.

Others

The double-sided coater 1 according to the present invention is not limited to the embodiments described above, and may have various configurations.

Figure 8:
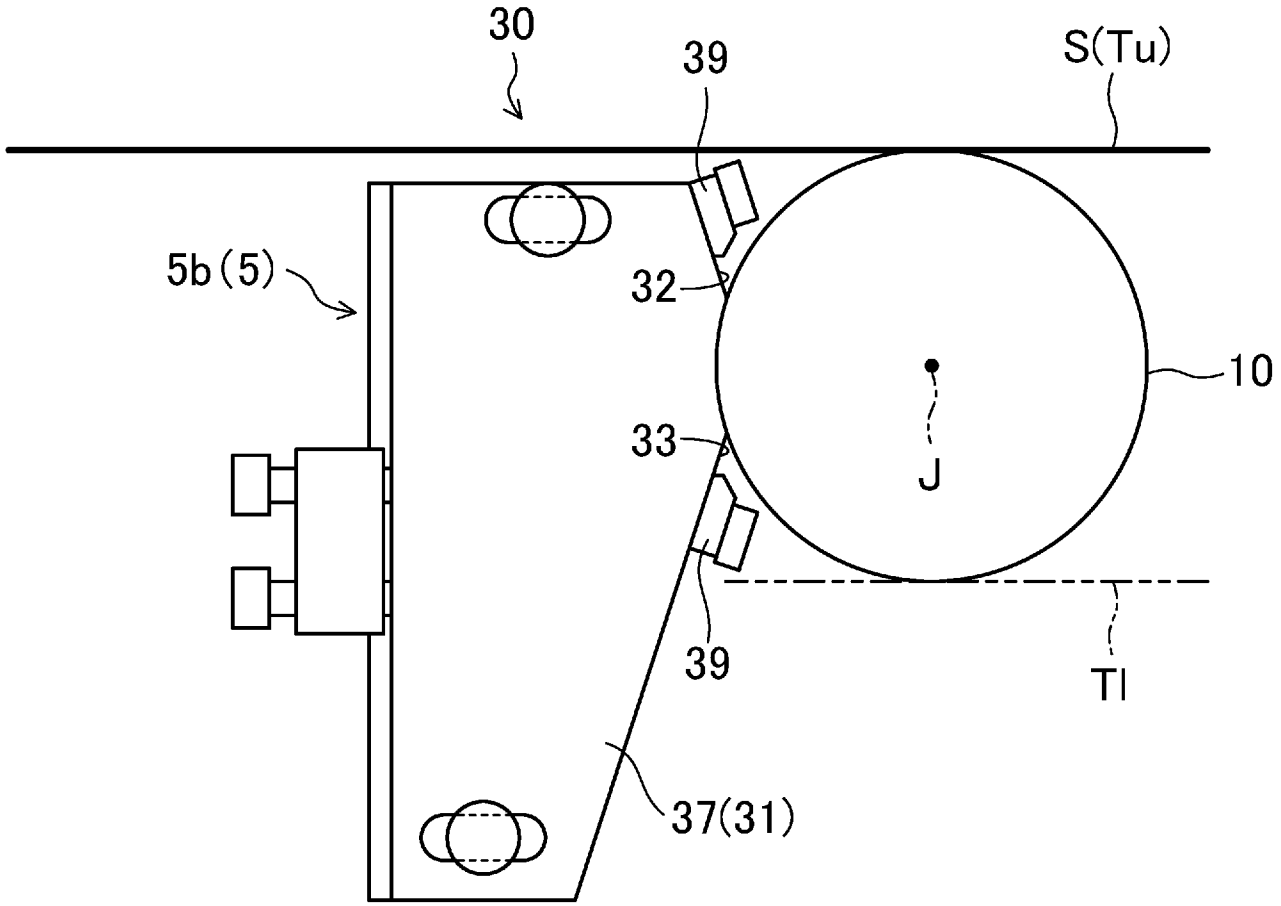
FIG. 8 is a general view of a coater according to a variation.

As shown in FIG. 8, the coating liquid supplier 30 may be formed such that only its uppermost end is located between a pair of tangent lines Tu and Tl contacting the associated upper and lower ends of the small-diameter gravure roll 10.

The positions of the unwinder 2, the winder 3, and the controller 8 in FIG. 1 are mere examples, and may be set as appropriate in accordance with the specifications.

DESCRIPTION OF REFERENCE CHARACTERS

1 Double-Sided Coater
2 Unwinder
3 Winder
4*a*-4*c* First to Third Guide Rolls
5*a* First Coater
5*b* Second Coater

6 End Supporter
7 Floating Drier
8 Controller
10 Small-Diameter Gravure Roll
12 Coating Section
30 Coating liquid Supplier
D Outside Diameter
J Rotational Axis
S Substrate

The invention claimed is:

1. A double-sided coater continuously coating two surfaces of a traveling substrate, the coater comprising:

a first guide roll supporting and guiding the substrate to allow the substrate to travel vertically upward;

a second guide roll located downstream of the first guide roll on a same surface of the substrate as the first guide roll, wound with the substrate, and guiding a traveling direction of the substrate, with the substrate having tension;

a first coater located next to and upstream of the second guide roll, and coating one of the surfaces not contacting the second guide roll;

a second coater located next to and downstream of the second guide roll, and coating the other one of the surfaces contacting the second guide roll; and a floating drier drying the substrate with the coated surfaces, wherein each of the first and second coaters is a gravure kiss coater including a cylindrical small-diameter gravure roll having an outside diameter within a range from 45 mm to 150 mm, and including, on an outer peripheral surface, a coating section contacting the traveling substrate while floating, and an enclosed coating liquid supplier capable of being placed transversely, the coating liquid supplier extending along the small-diameter gravure roll, and supplying coating liquid to the coating section, in a transverse position, an uppermost end of at least the coating liquid supplier of the second coater is located under a tangent line tangent to an upper end of the small-diameter gravure roll as seen along a rotational axis of the small-diameter gravure roll, and both the first and second coaters are next to the second guide roll while being placed transversely, and the second guide roll guides the substrate from a vertical direction to a horizontal direction to allow the first coater to coat the substrate from a lateral point while the substrates travels vertically, and to allow the second coater to coat the substrate from a lower point while the substrate travels horizontally.

2. The double-sided coater of claim 1, wherein the substrate includes a non-coated region at its ends in a width direction, and the double-sided coater further comprises, between the second coater and the floating drier, an end supporter clamping the non-coated region of the traveling substrate.

* * * * *